US008777660B2

(12) United States Patent
Chiarelli et al.

(10) Patent No.: US 8,777,660 B2
(45) Date of Patent: Jul. 15, 2014

(54) ELECTRIC CONNECTOR WITH A CABLE CLAMPING PORTION

(75) Inventors: Davide Chiarelli, Swindon (GB); Giovanni Turco, Turin (IT)

(73) Assignee: Tyco Electronics AMP Italia SRL, Collegno Torino (IT)

( * ) Notice: Subject to any disclaimer, the term of this patent is extended or adjusted under 35 U.S.C. 154(b) by 0 days.

(21) Appl. No.: 13/559,328

(22) Filed: Jul. 26, 2012

(65) Prior Publication Data

US 2013/0029541 A1 Jan. 31, 2013

(30) Foreign Application Priority Data

Jul. 26, 2011 (DE) ..... 20 2011 103 702 U

(51) Int. Cl.

| | |
|---|---|
| ***H01R 9/05*** | (2006.01) |
| ***H01R 13/59*** | (2006.01) |
| *H01R 13/52* | (2006.01) |
| *H01R 9/03* | (2006.01) |

(52) U.S. Cl.

CPC ..... *H01R 13/59* (2013.01); *H01R 13/5205* (2013.01); *H01R 9/03* (2013.01)

USPC ..... 439/584; 439/752

(58) Field of Classification Search

USPC ..... 439/584, 752, 686, 690

See application file for complete search history.

(56) References Cited

U.S. PATENT DOCUMENTS

| | | | | |
|---|---|---|---|---|
| 4,354,723 | A * | 10/1982 | Lee | 439/462 |
| 4,447,107 | A * | 5/1984 | Major et al. | 439/584 |
| 4,655,159 | A * | 4/1987 | McMills | 116/212 |
| 4,990,094 | A | 2/1991 | Chandler et al. | |
| 6,739,882 | B2 * | 5/2004 | Fuehrer et al. | 439/95 |
| 6,752,650 | B1 * | 6/2004 | Lin | 439/491 |
| 7,101,192 | B1 * | 9/2006 | Bordeau et al. | 439/66 |
| 8,157,587 | B2 * | 4/2012 | Paynter et al. | 439/578 |
| 8,414,313 | B2 * | 4/2013 | Rodrigues et al. | 439/133 |
| 8,454,385 | B2 * | 6/2013 | Chawgo et al. | 439/584 |
| 8,475,192 | B2 * | 7/2013 | Kantor | 439/273 |
| 2003/0135999 | A1 * | 7/2003 | Khemakhem et al. | 29/857 |
| 2010/0216353 | A1 * | 8/2010 | Wellmann | 439/752.5 |
| 2013/0029541 | A1 * | 1/2013 | Chiarelli et al. | 439/781 |

OTHER PUBLICATIONS

Appendix B, Manufacturer Instruction Sheets; Assembly Procedures for AMP Four Position Universal Data Connector Kits, Instruction Sheet 408-3195, Oct. 5, 1994, Rev. D, © 1995 AMP Incorporated, Harrisburg, PA; 38 pages.

Tyco/Electronics AMP Assembly Procedures for Four Position Data Connector Kits 554000, 557900, and Strain Relief Kits 555002; Notice Technique 408-3110-1, Mar. 17, 1999, Rev. H; 8 pages.

AMP Incorporated, AMP 4805 Rev Jun. 11, 1997; Data Connector Kit, 4 Position, IEEE 802.5, Drawing No. 554000-1; 1 page.

* cited by examiner

*Primary Examiner* — James Harvey

(74) *Attorney, Agent, or Firm* — Faegre Baker Daniels LLP

(57) ABSTRACT

An electric connector comprises a connector body and a plurality of contact elements mounted within the connector body and adapted to be coupled with mating contact elements at the front end of the connector body. The contact elements are connected to respective wires of an electric cable provided with a sheath. The electric cable is clamped within the connector body by means of a cable clamping tubular portion, having clamping longitudinal tabs. A wedge-like locking bush having a conical inner surface is mounted above the longitudinal tabs of the clamping tubular portion. A locking ring-nut is tightened on a threaded portion of the rear end of the connector body so as to clamp the cable.

15 Claims, 13 Drawing Sheets

ELECTRIC CONNECTOR WITH A CABLE CLAMPING PORTION

FIELD OF THE DISCLOSURE

The present invention relates to an electric connector comprising: a connector body having a front end and a rear end, a plurality of contact elements mounted within the connector body and able to be coupled with mating contact elements at the front end of the connector body, said contact elements being adapted to be connected to respective wires of an electric cable provided with a sheath, and means for clamping the electric cable within the connector body.

BACKGROUND OF THE DISCLOSURE

The main purpose of the present invention is that of providing an electric connector of the above indicated type which has a relatively simple and inexpensive structure, which in particular can be manufactured and assembled simply and rapidly and finally which is adapted to be put into operation also in a simple and quick manner.

A further object of the present invention is that of providing an electric connector which can be used for instance in lighting apparatus, and which ensures a tightly sealed connection, so as to satisfy the increasingly strict requirements provided for by the current regulations.

In order to achieve these objects, the invention provides an electric connector having the above indicated features and further characterised in that said means for locking the electric cable comprise: a cable clamping tubular portion, having clamping longitudinal tabs which are elastically deformable, said portion being connected to said connector body, a wedge-like locking bush having an inner conical surface, mounted above the longitudinal tabs of said clamping portion, and a locking ring-nut which can be tightened on a threaded portion of the rear end of the connector body in order to axially urge said wedge-like locking bush above the tabs of said cable clamping portion, so as to clamp the cable within said tabs.

SUMMARY

In the preferred embodiment, the electric connector further comprises a first sealing ring for engagement on the cable and interposed between said wedge-like locking bush and said locking ring-nut, so as to prevent the passage of water at the rear end of the connector.

Also in the case of said preferred embodiment, the electric connector further comprises a second sealing ring interposed between said locking ring-nut and said connector body, for preventing the passage of water at a central portion of the connector.

Also in the case of said preferred embodiment, the electric connector comprises a contact positioning element which can be mounted within said connector body and having a front portion for receiving and locking thereon said contact elements before that the contact elements are inserted into the connector body. The positioning element also comprises a rear portion provided with retaining longitudinal tabs which are elastically deformable and have wedge-shaped teeth at their free ends. These teeth cooperate with respective windows formed at a rear end of said connector body, for snap-locking said positioning element within said connector body.

In the preferred embodiment, the front portion of the locking ring-nut has a thread adapted to cooperate with said threaded portion of the rear end of the connector body. Furthermore, the locking ring-nut has a rear portion with a plurality of lateral planar faces for engagement by a tightening tool.

Finally, also in the case of said preferred embodiment, on the circumferential edge of its end opposite to that provided with the clamping longitudinal tabs, the cable clamping portion comprises projections adapted to be coupled with cooperating recesses formed on the edge of said rear end of the connector body, so as to prevent the rotation of the clamping portion relative to the connector body when the locking ring-nut is tightened on the connector body.

The electric connectors of the above described type may have a socket-type connector body or a plug-type connector body. In a socket-type connector body, the contact elements are of the plug-type, whereas in the case of a plug-type connector body, the contact elements are of the socket-type.

Moreover, there are two kinds of contact elements which can be used in these electric connectors, namely contact elements where the wire is clamped by a screw and contact elements which are crimped on the wire. In the former case the connector is supplied in a fully assembled condition and the wires of the electric cable are inserted into the respective contact elements and clamped therein by clamping screws arranged through holes provided at the rear end of the contact elements. On the other hand, in the case of crimped contact elements, the contact elements are mounted on the wires of the electric cable and then clamped thereon by crimping; therefore in this case the connector is supplied in a non-assembled condition, so that this preliminary operation can be carried out.

BRIEF DESCRIPTION OF THE DRAWINGS

Further features and advantages of the invention will become readily apparent from the description which follows with reference to the annexed drawings, given purely by way of non limiting example, in which.

DETAILED DESCRIPTION

Figure 7:
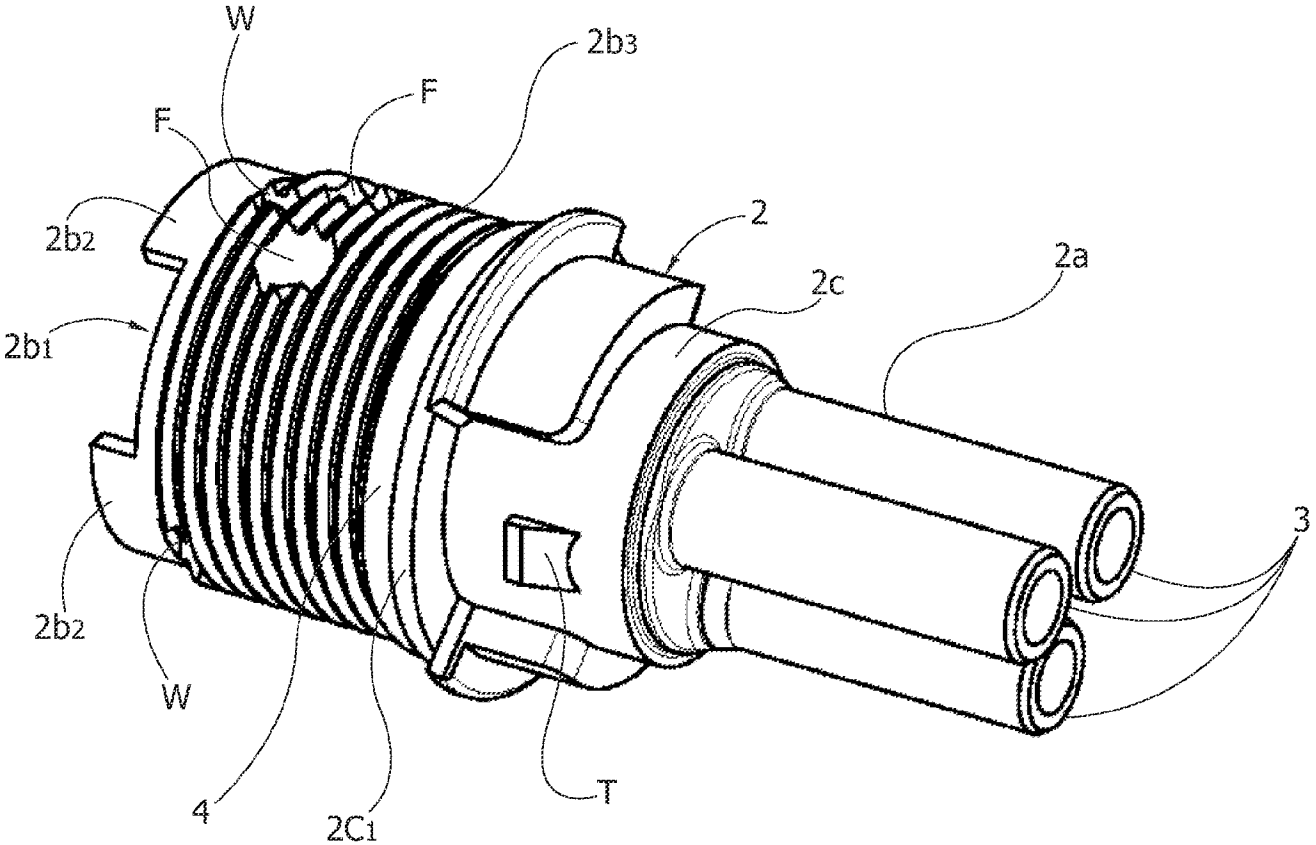
FIGS. 7 and 8 are diagrammatic perspective views of two different types of connector body, namely of a plug-type connector body and of a socket-type connector body.
Figure 9:
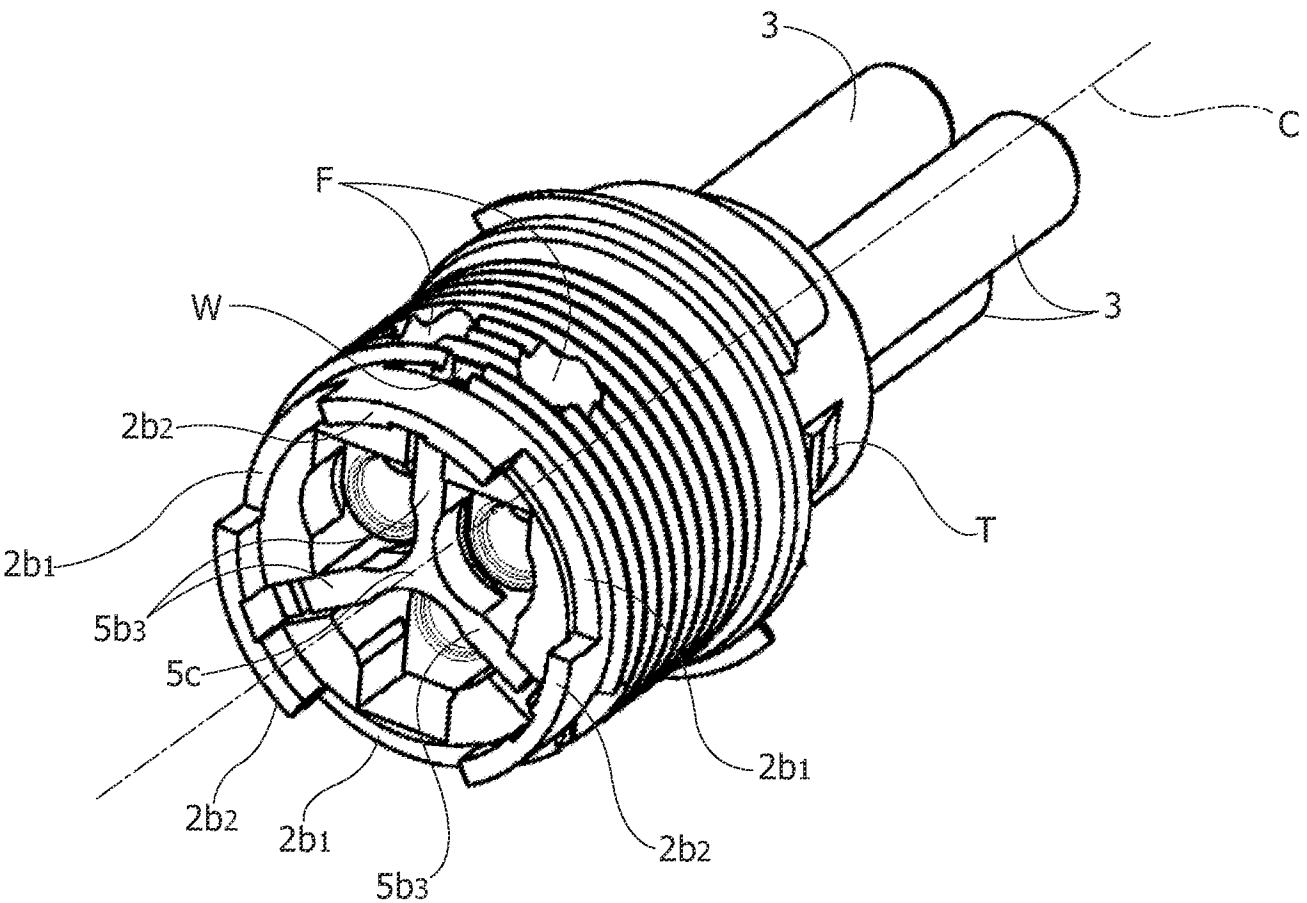
FIG. 9 is a rear perspective view of the connector body of FIG. 7, FIGS. 10*a*,10*b*,10*c* and 10*d* are enlarged perspective views of contact elements of the plug-type and of the socket-type respectively, and both in the screw-type version and in the crimped version.
Figure 10A:
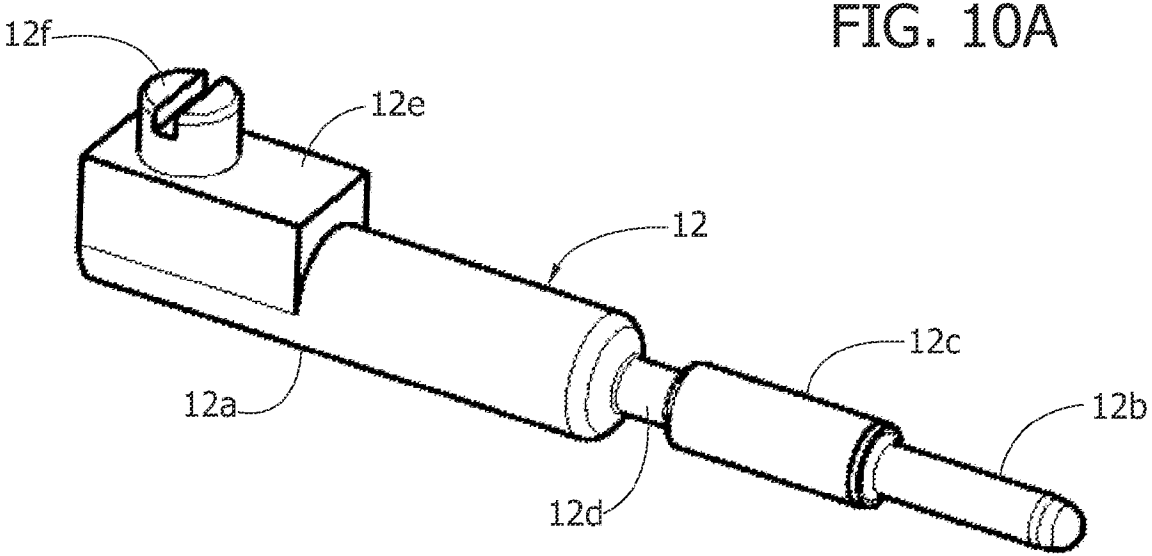
Figure 10B:
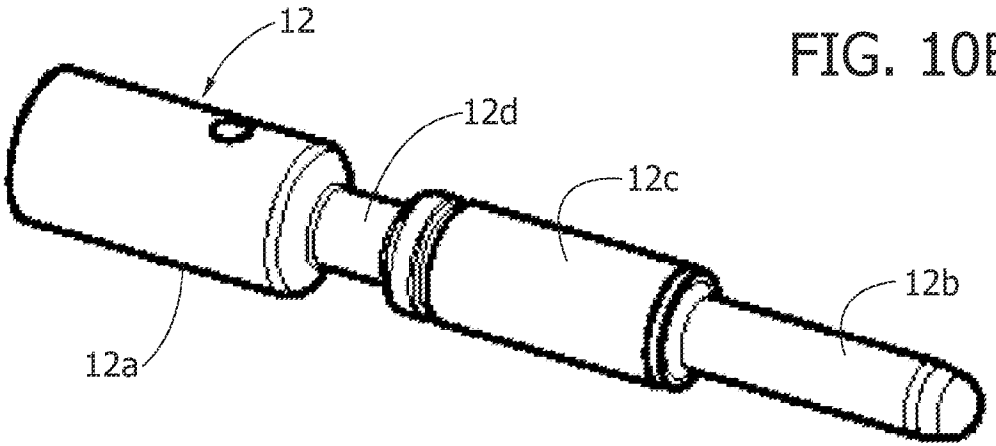
Figure 10C:
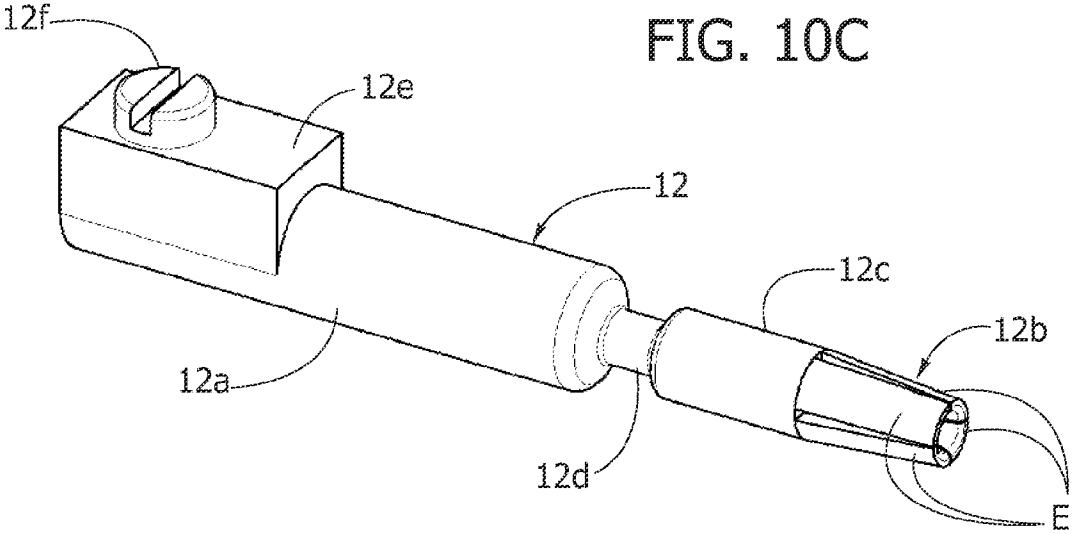
Figure 10D:
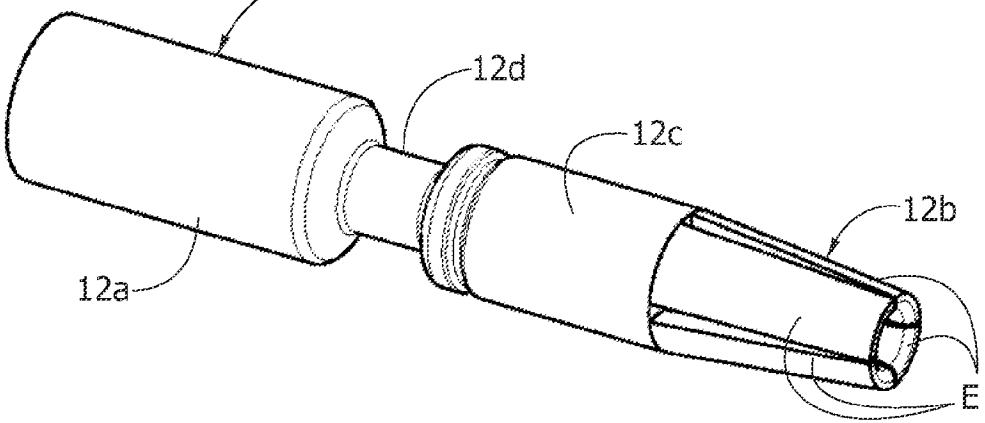

With reference to the drawings, numeral 1 generally designates an electric connector having a connector body 2. With reference in particular to FIGS. 7 and 9, the connector body 2 is made of plastic material and comprises a front end 2*a* which includes three substantially tubular bodies 3. The tubular bodies 3 extend from a central portion 2*c* of the connector body 2 and define three axial cylindrical cavities arranged circumferentially around the central axis of the connector body 2, for receiving three contact elements 12. The rear end 2*b* of the connector body comprises a threaded portion 2*b*3.

Figure 8:
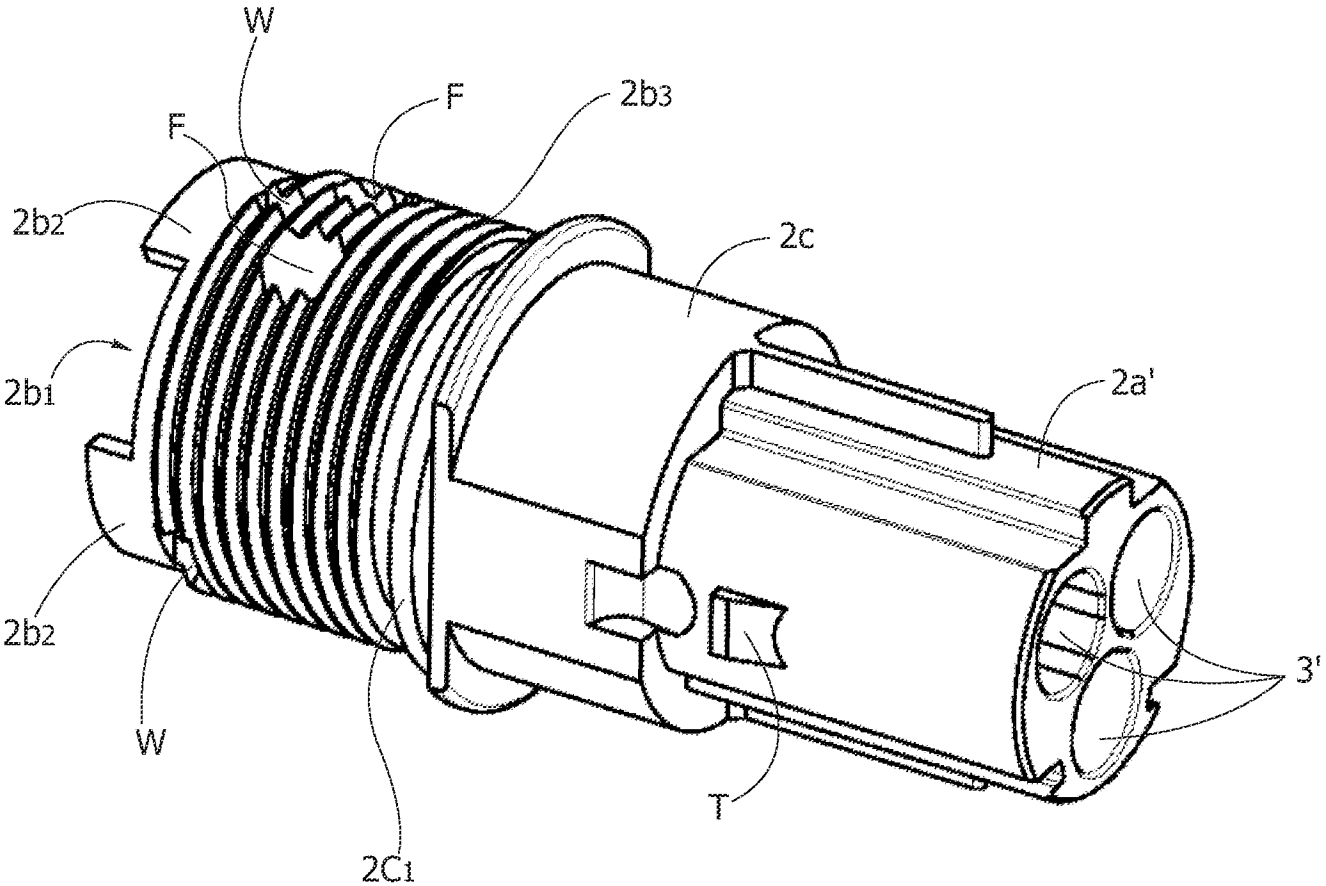

With reference to FIG. 8, which shows a socket-type connector body, the front end 2*a*' of the connector body 2 has a substantially tubular shape and comprises three cylindrical cavities 3' adapted to receive three mating tubular bodies 3 of a cooperating connector body of the plug-type.

Still with reference to FIGS. 7 through 9, on the outer surface of its front end 2*a*, the connector body 2 comprises two wedge-shaped teeth T located at diametrically opposite positions relative to each other and able to be engaged within cooperating surfaces formed on the mating connector.

Figure 1:
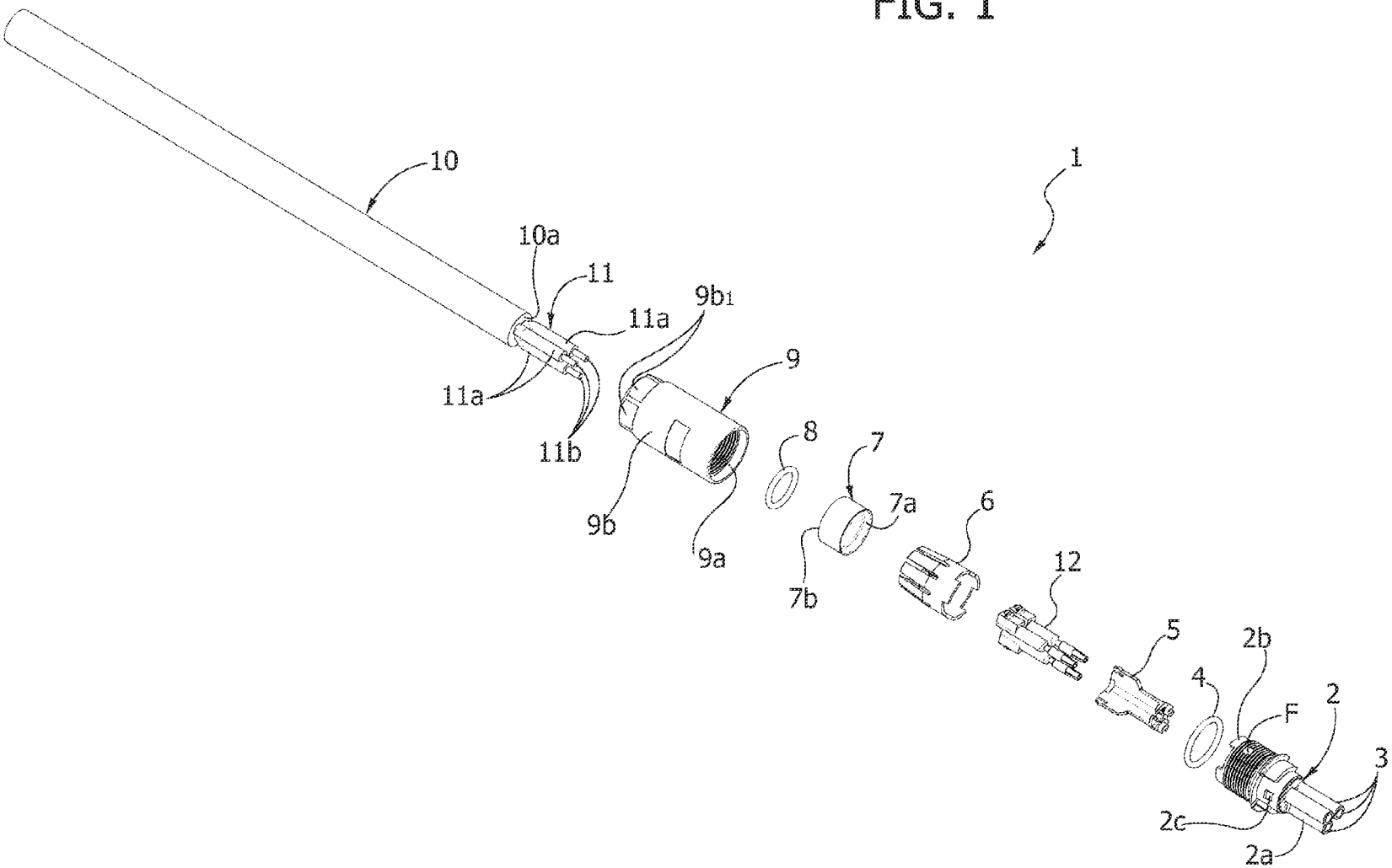
FIGS. 1-6 are diagrammatic perspective views which show different steps for assembling the connector according to the invention.

In FIG. 1 the electric connector 1 is shown in an exploded view, where clearly visible are a first sealing ring 4, a positioning element 5, a cable clamping tubular portion 6, a wedge-like locking bush 7, a second sealing ring 8 and a locking ring-nut 9.

Also in FIG. 1 there is further illustrated an electric cable 10 provided with an insulating sheath 10*a*, and including three wires 11 within the sheath which are arranged circumferentially around the central axis of the electric cable 10. As shown in particular in FIG. 3, each wire 11 of the electric cable 10 comprises a protective sheath 11*a* and a naked conductive portion 11*b*.

FIGS. 2 through 6 show different steps of the assembling of connector 1. The sequence shown therein refers, by way of example, to the case of a plug-type connector body with socket-type contact elements provided with clamping screws.

Figure 2:
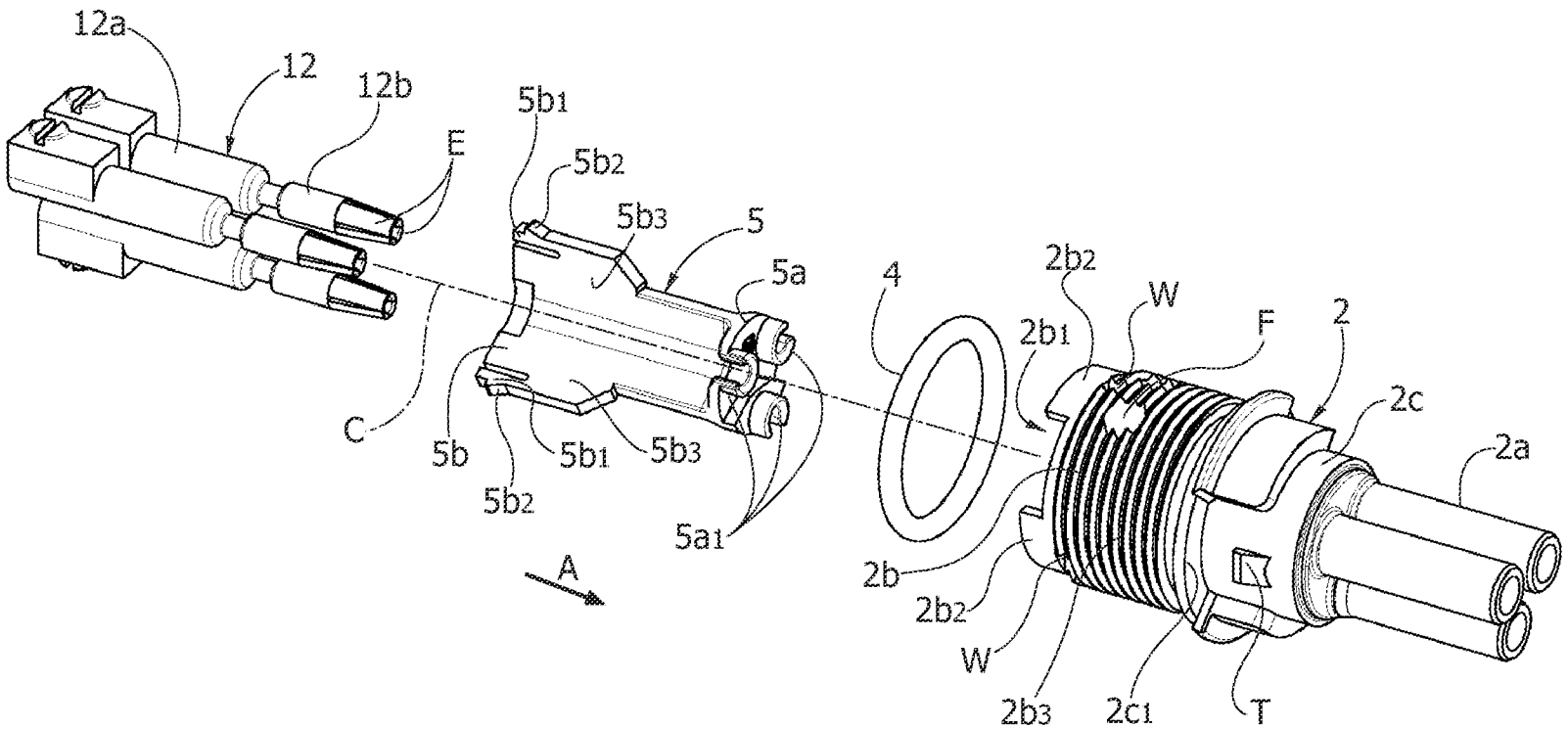

With reference to FIG. 2, a first part of the connector 1 is assembled by inserting the socket-type contact elements 12 provided with clamping screws within the positioning element 5, the assembly of these elements being then inserted into the rear end 2*b* of the connector body 2 in the direction indicated by arrow A.

With reference in particular to FIGS. 10*a*, 10*b*, 10*c* and 10*d*, the contact elements 12 comprise a rear, substantially tubular, portion 12*a*, which is for receiving the naked conductive portion 11*b* of a wire 11 of the electric cable 10. Each contact element 12 further comprises a front portion 12*b* defining the contact and two intermediate cylindrical portions 12*c* and 12*d*. The intermediate portion 12*d* has a reduced diameter relative to the adjacent portions. In the case of a contact element 12 with clamping screw there are further provided a flange portion 12*e* which extends on the tubular rear portion 12*a* and a clamping screw 12*f* arranged on this flange portion 12*e*. Finally, the front portion 12*b* of the contact element 12 can be either of the plug-type (see FIGS. 10*a* and 10*b*) or of the socket type (see FIGS. 10*c* and 10*d*). In case of socket type contact elements, the front portion 12*b* comprises elastically deformable wings E (see FIGS. 10*c* and 10*d*).

The positioning element 5 comprises a front portion 5*a* adapted to receive and lock the contact elements 12 before they are inserted into the connector body 2. The positioning element 5 also comprises a rear portion 5*b* provided with retaining longitudinal tabs 5*b*1 which are elastically deformable and have wedge-like teeth 5*b*2 at their free ends, which cooperate with respective windows W (see FIG. 2) formed at the rear end 2*b* of the connector body 2, for snap-locking the positioning element 5 within the connector body 2.

With reference to FIG. 2, the rear portion 5*b* of the positioning element 5 comprises three walls 5*b*3 (see FIG. 2 and FIG. 9) which extend radially from a central portion 5*c* arranged along the central axis C. The front portion 5*a* of the positioning element 5 comprises a disk-like portion with three latching clamp portions 5*a*1, which are U-shaped and elastically deformable, for engaging and retaining respective intermediate cylindrical portions 12*d* of the contact elements 12.

Preferably, the positioning element 5 is made of plastic material and is moulded in a single piece.

Figure 3:
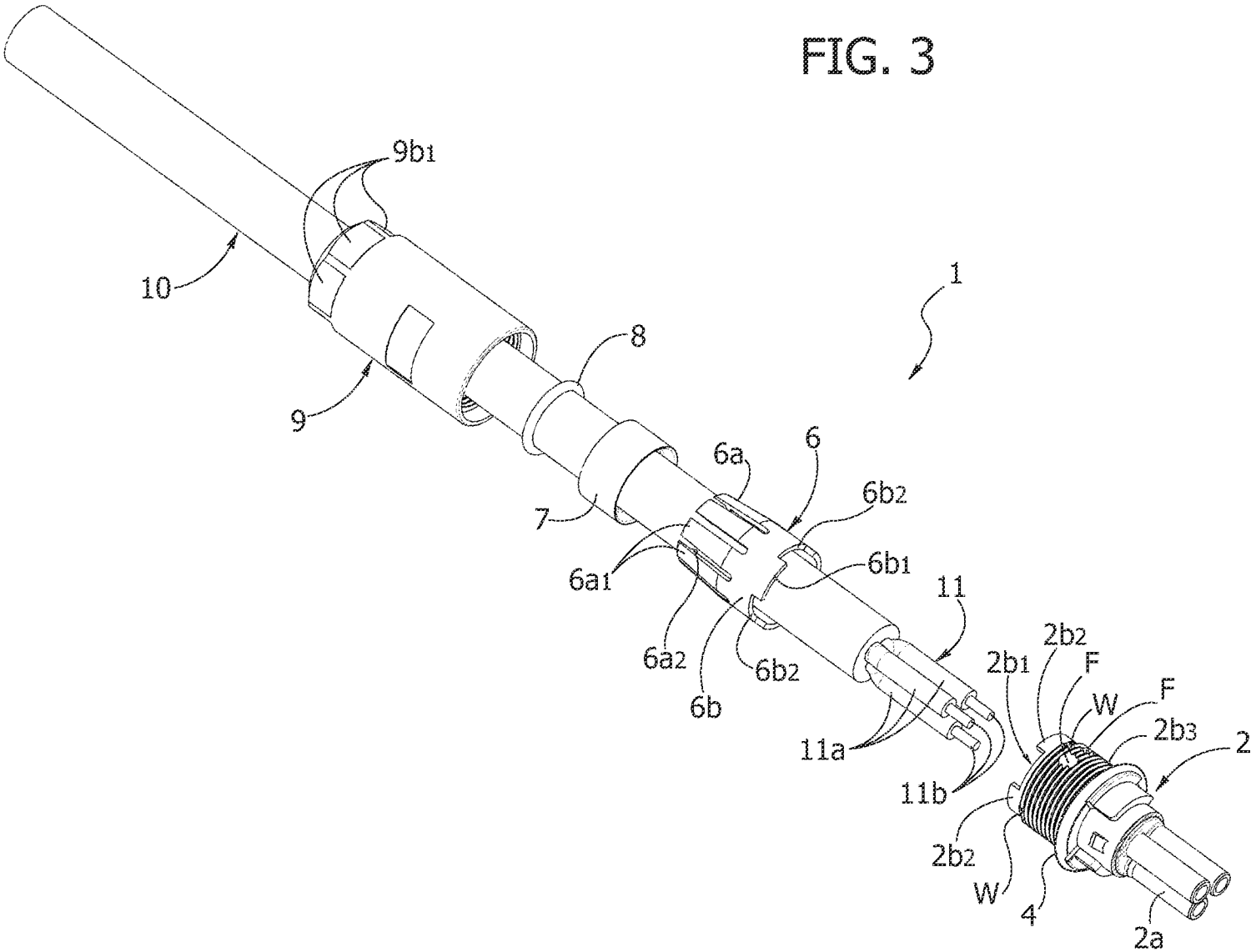

Once the assembly formed by the positioning element 5 and the contact elements 12 is inserted into the rear end 2*b* of the connector body 2, a sealing ring 4 of the O-ring type is mounted on the outer surface of the rear end 2*b* of the connector body 2 (see FIGS. 2 and 3). This sealing ring 4 stops against a circumferential edge 2*c*1 of enlarged diameter formed at the central portion 2*c* of the connector body 2. When the connector is completely assembled, the sealing ring 4 is interposed between the locking ring-nut 9 and the connector body 2, for preventing the passage of water at the central portion of the connector.

With reference to FIG. 3, on cable 10 there are mounted in sequence the locking ring-nut 9, the second sealing ring 8, the wedge-like locking bush 7 and the clamping tubular portion 6.

Figure 4:
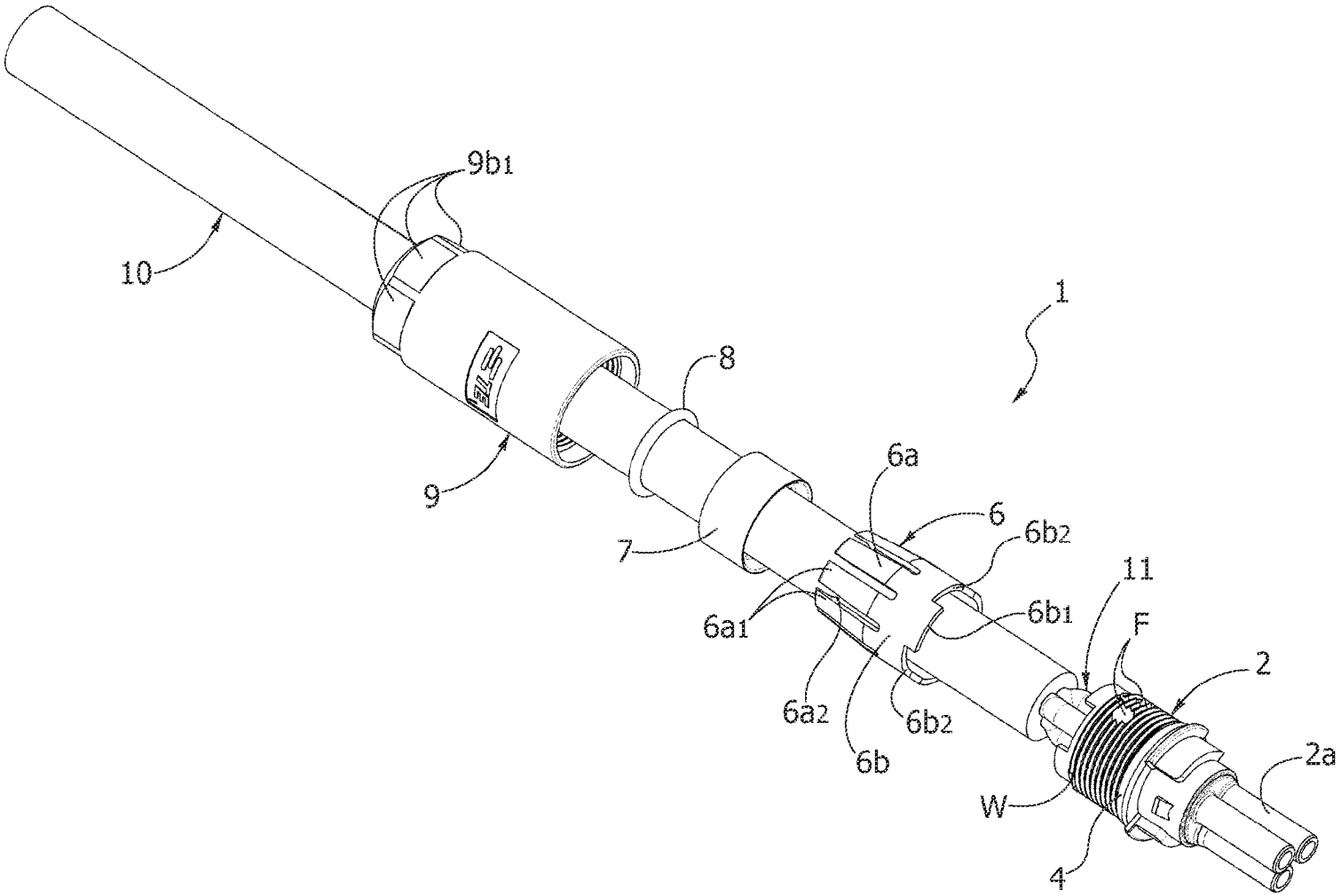

With reference to the steps shown in FIG. 3 and FIG. 4, the naked conductive portions 11*b* of the wires 11 are received within respective tubular rear portions 12*a* of the contact elements 12. Screws 12*f* are tightened with the aid of a screw driver inserted through holes F (see FIG. 9) provided at the rear end of the connector body 2, so that the electrical and mechanical connection is obtained.

Figure 5:
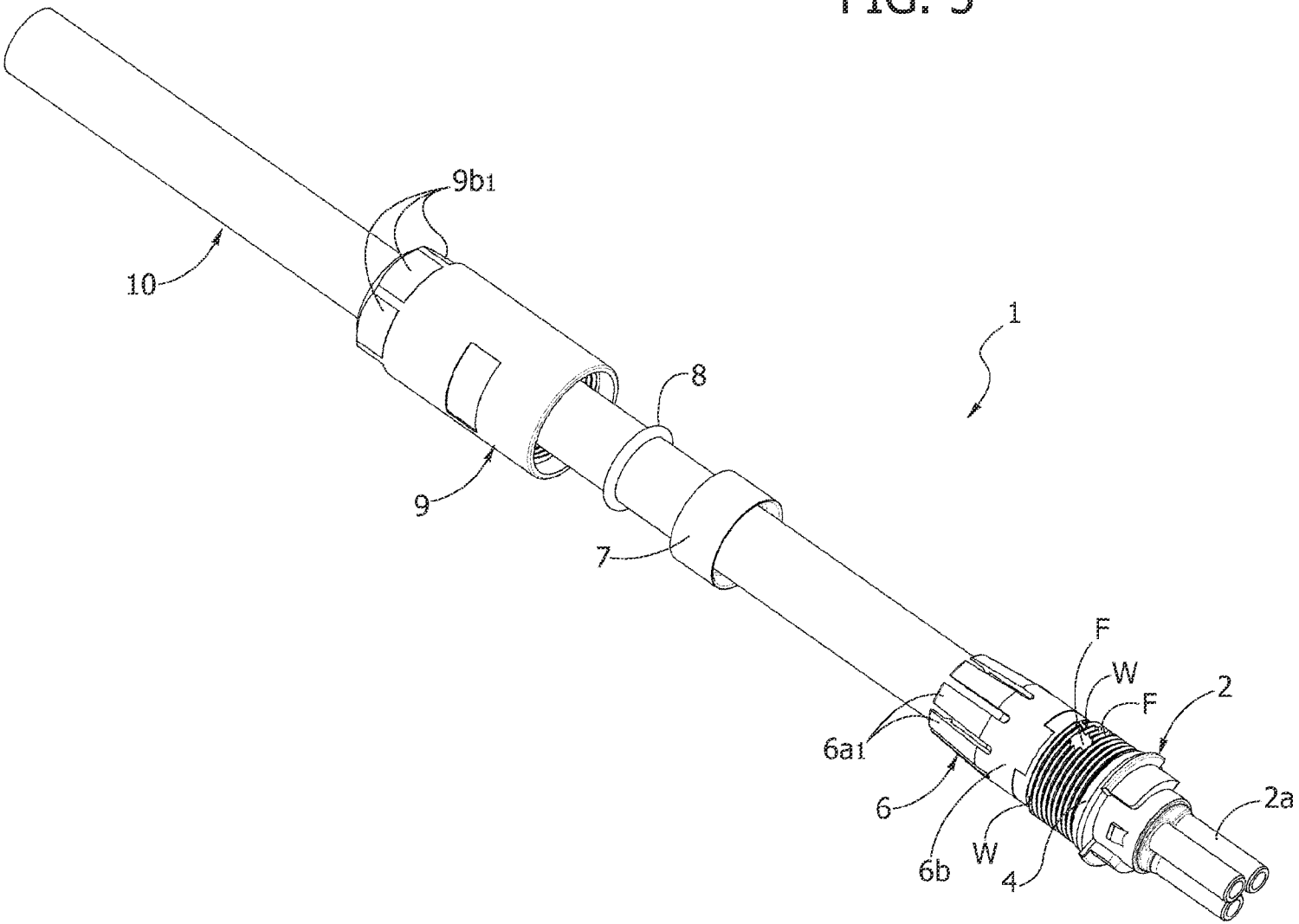

Once the screws 12*f* are tightened, the clamping tubular portion 6 can be moved close to the connector body 2 (FIG. 5).

Also with reference to FIGS. 3 through 5, the tubular clamping portion 6 has elastically deformable clamping longitudinal tabs 6*a*1 provided at its rear portion 6*a*. On the inner surface of their free ends, these clamping longitudinal tabs 6*a*1 have wedge-like teeth 6*a*2 (shown in cross-section in FIGS. 11 and 12) adapted to press the sheath 10*a* of the electric cable 10. The clamping tubular portion 6 also has projections 6*b*1 on the circumferential edge of its opposite end 6*b*, which are adapted to be coupled with corresponding recesses 2*b*1 formed on the edge of the rear end 2*b* of the connector body 2, for securing the clamping tubular portion 6 on the connector body 2. This arrangement (with recesses 6*b*2 and projections 2*b*2) serves for preventing the rotation of the clamping tubular portion 6 relative to the connector body 2 when the ring-nut 9 is tightened on the connector body 2.

The clamping tubular portion 6 is thus connected to the connector body 2 (see FIG. 5) so that the projections 6*b*1 are received within the cooperating recesses 2*b*1 of the connector body 2, thereby preventing any relative rotation of the two bodies.

The wedge-like locking bush 7 has an inner conical surface and is mounted above the longitudinal tabs 6*a*1 of the clamping portion 6 in order to clamp them on the cable 10. The locking bush 7 has two ends 7*a* and 7*b* having different inner diameters. When assembling the connector 1, bush 7 is mounted on the cable 10 so that the end 7*a* with greater inner diameter faces towards the clamping tubular portion 6.

The inner surface of the front portion of the ring-nut 9 has a thread adapted to cooperate with the thread portion 2*b*3 of the rear end of the connector body. Furthermore, the ring-nut 9 has a rear portion 9*b* with a plurality of planar lateral faces 9*b*1 for engagement by a tightening tool.

Figure 6:
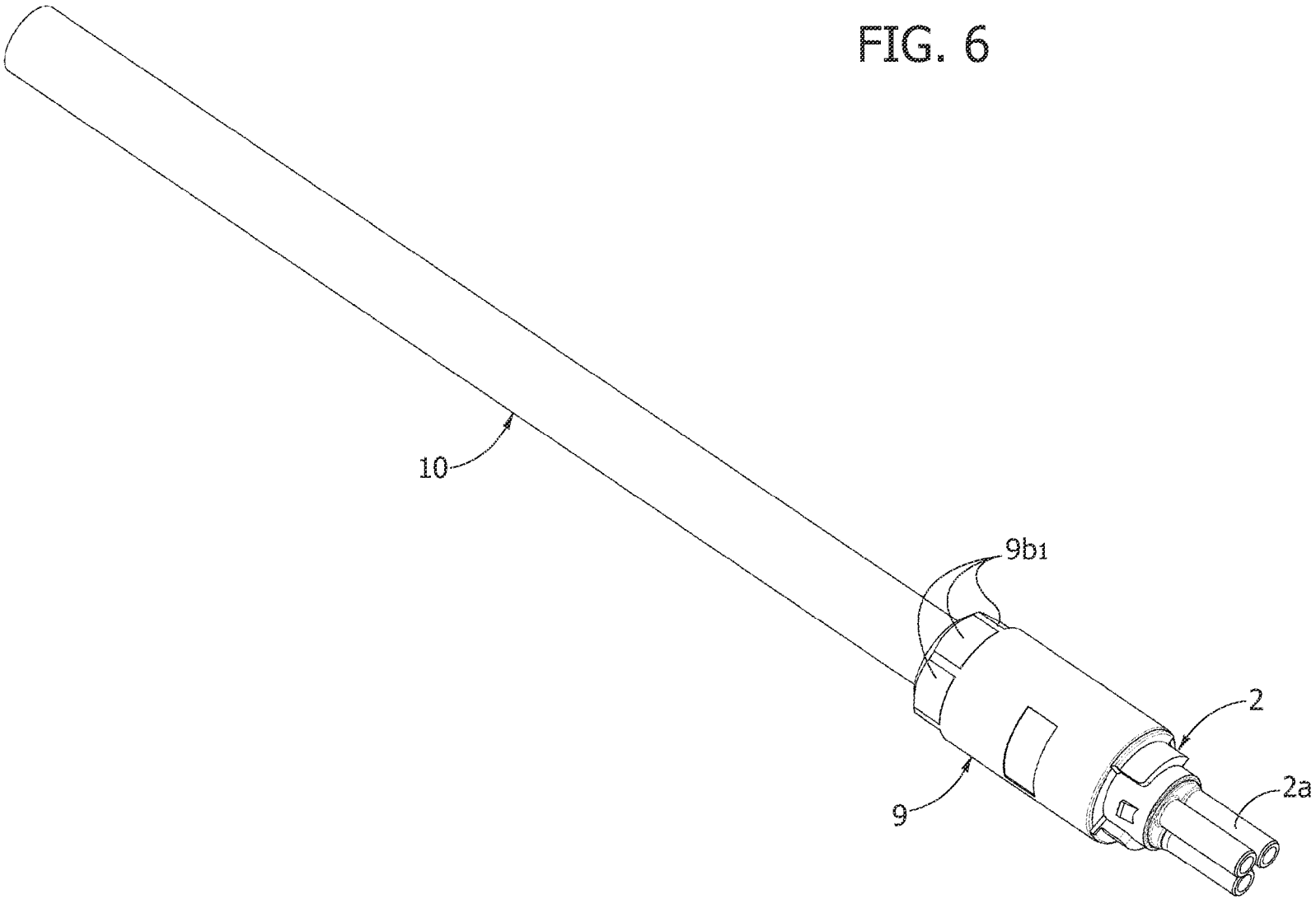

The locking ring-nut 9 is tightened on the threaded portion 2*b*3 of the rear end 2*b* of the connector body 2 (FIG. 6). When tightening the ring-nut 9, the wedge-like bush 7 is biased above the tabs 6*a* of the cable clamping portion 6 and is urged axially thereon so that the teeth 6*a*2 are pressed against the sheath 10*a*, so as to clamp cable 10 within tabs 6*a*.

Figure 11:
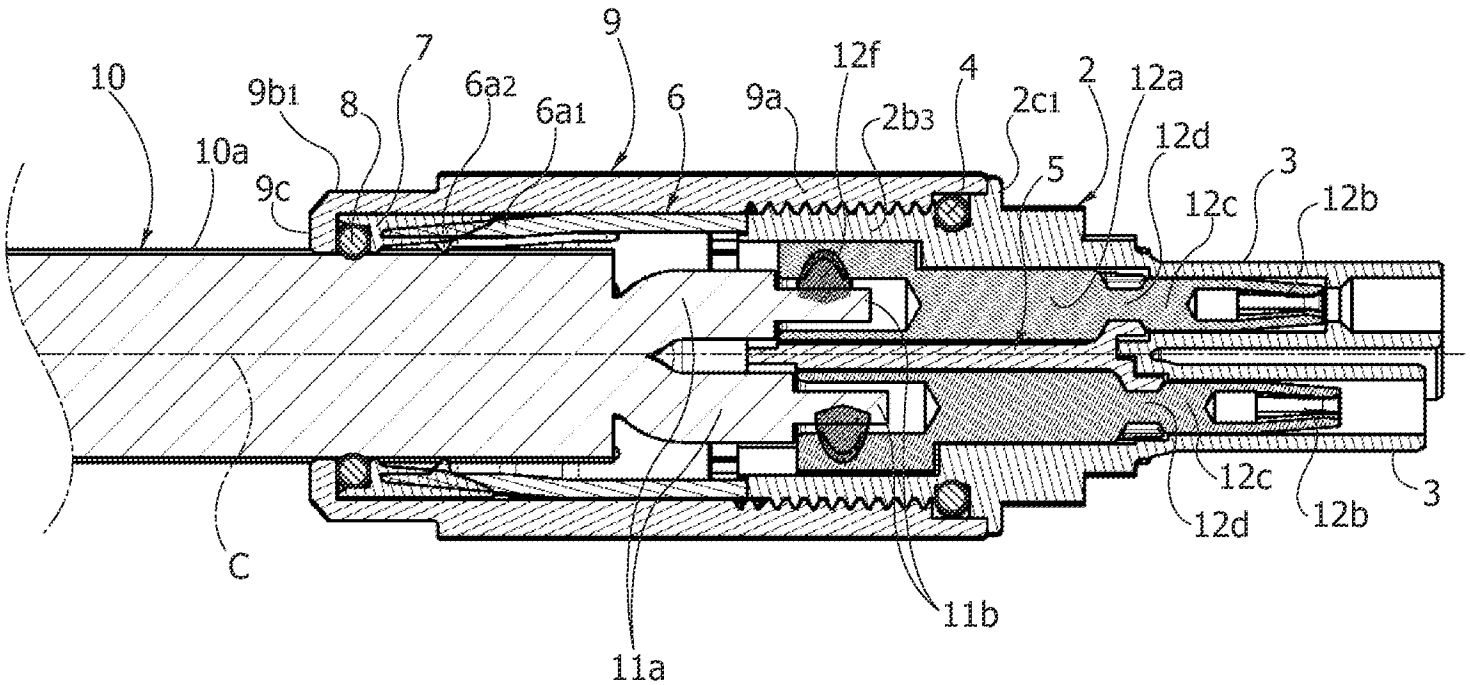
FIGS. 11 and 12 are two cross-sectional views of the connector in its fully assembled condition, with screw-type contact elements and crimped contact elements, respectively.
Figure 12:
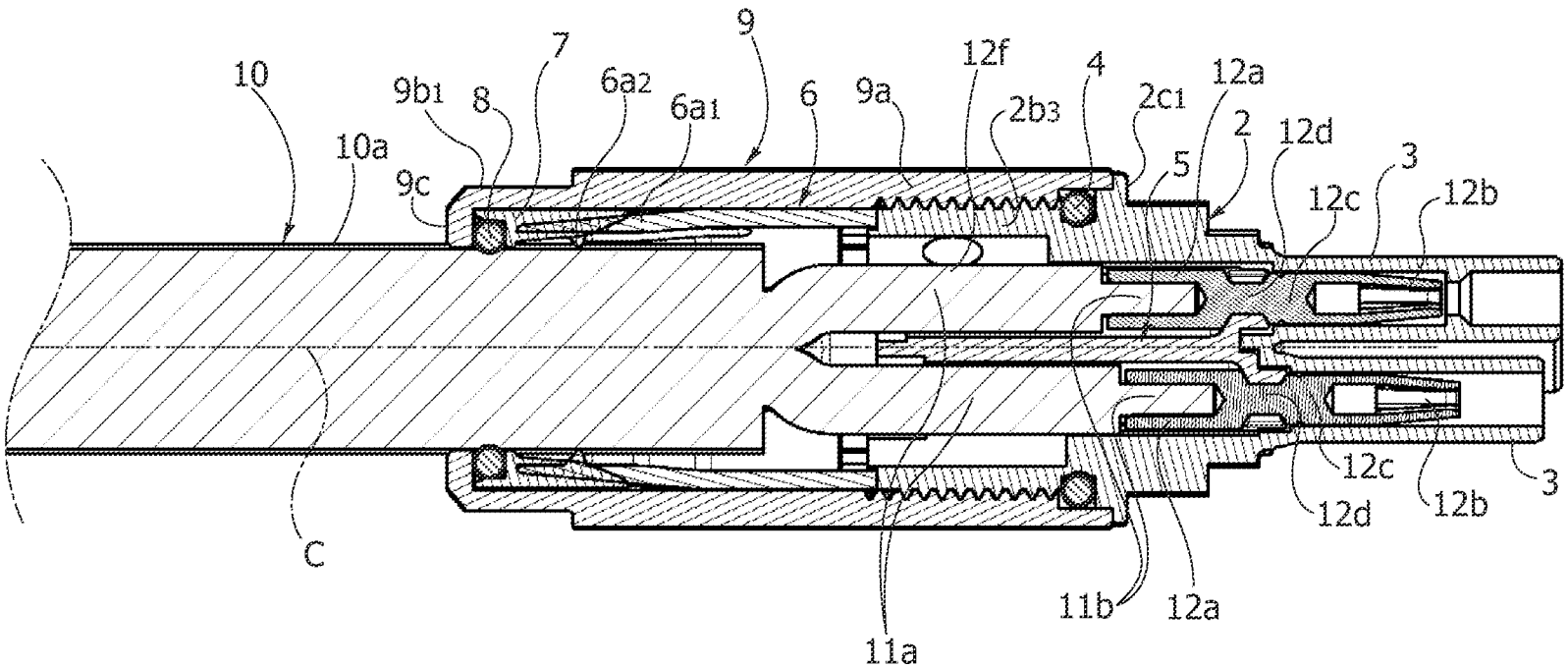

In the fully coupled condition of the connector 1, see FIGS. 11 and 12, the ring-nut 9 is completely tightened on the body 2 and the circumferential edge 2*c*1 of enlarged diameter serves as an end stop for the ring-nut 9. Also with reference with these figures, on the inner surface of its rear portion 9*b*, the ring-nut 9 has a circumferential edge 9*c* having a reduced diameter which serves as a stop for the sealing ring 8 and the wedge-like bush 7.

Naturally, while the principle of the invention remains the same, the details of construction and the embodiments may widely vary with respect to what has been described and shown merely by way of example, without departing from the scope of the present invention as defined in the annexed claims.

What is claimed is:

1. Electric connector comprising:

a connector body having a front end and a rear end, a plurality of contact elements mounted within the connector body and able to be coupled with mating contact elements at the front end of the connector body, said contact element being connectable to respective wires of an electric cable provided with a sheath, and means for clamping the electric cable within said connector body, comprising:

a cable clamping tubular portion having clamping longitudinal tabs which are elastically deformable, said portion being connected to said connector body, a wedge-like locking bush having an inner conical surface, mounted above said longitudinal tabs of said cable tubular clamping portion, a locking ring-nut which can be tightened above a threaded portion of the rear end of the connector body, for axially urging said wedge-like bush above the tabs of said cable clamping portion so as to clamp the cable within said tabs, and a positioning element which can be mounted within said connector body and having a front portion adapted to receive and lock thereon said contact elements, before these contact elements are inserted into the connector body, wherein said positioning element comprises a rear portion provided with retaining longitudinal tabs which are elastically deformable and have at their free ends wedge-like teeth cooperating with respective windows formed on the rear end of said connector body, for snap-locking said positioning element within said connector body.

2. Electric connector according to claim 1, further comprising a sealing ring for engagement on the cable and interposed between said wedge-like locking bush and said locking ring-nut, so as to prevent the passage of water at the rear end of the connector.

3. Electric connector according to claim 1, further comprising a sealing ring interposed between said locking ring-nut and said connector body, so as to prevent the passage of water at the central portion of the connector.

4. Electric connector comprising:

a connector body having a front end and a rear end, a plurality of contact elements mounted within the connector body and able to be coupled with mating contact elements at the front end of the connector body, said contact element being connectable to respective wires of an electric cable provided with a sheath, and means for clamping the electric cable within said connector body, comprising:

a cable clamping tubular portion having clamping longitudinal tabs which are elastically deformable, said portion being connected to said connector body, a wedge-like locking bush having an inner conical surface, mounted above said longitudinal tabs of said cable tubular clamping portion, a locking ring-nut which can be tightened above a threaded portion of the rear end of the connector body, for axially urging said wedge-like bush above the tabs of said cable clamping portion so as to clamp the cable within said tabs, and wherein on a circumferential edge of an end opposite to that provided with said retaining longitudinal tabs, said cable clamping tubular portion comprises projections adapted to be coupled with cooperating recesses formed on an edge of said rear end of the connector body, for preventing a rotation of the clamping portion relative to the connector body when tightening the locking ring-nut on the connector body.

5. Electric connector according to claim 4, wherein said locking ring-nut has a rear portion with a plurality of planar lateral faces for engagement by a tightening tool.

6. Electric connector according to claim 1, wherein an inner surface of a front portion of said locking ring-nut has a thread adapted to cooperate with said threaded portion of the rear end of the connector body.

7. Electric connector according to claim 1, wherein said locking ring-nut has a rear portion with a plurality of planar lateral faces for engagement by a tightening tool.

8. Electric connector according to claim 1, wherein said retaining longitudinal tabs of the cable clamping tubular portion have wedge-like teeth at the inner surface of their free ends, which are adapted to be engaged against said sheath of the electric cable.

9. Electric connector according to claim 1, wherein on a circumferential edge of an end opposite to that provided with said retaining longitudinal tabs, said cable clamping tubular portion comprises projections adapted to be coupled with cooperating recesses formed on an edge of said rear end of the connector body, for preventing a rotation of the clamping portion relative to the connector body when tightening the locking ring-nut on the connector body.

10. Electric connector according to claim 4, wherein said retaining longitudinal tabs of the cable clamping tubular portion have wedge-like teeth at the inner surface of their free ends, which are adapted to be engaged against said sheath of the electric cable.

11. Electric connector according to claim 4, further comprising a sealing ring for engagement on the cable and interposed between said wedge-like locking bush and said locking ring-nut, so as to prevent the passage of water at the rear end of the connector.

12. Electric connector according to claim 4, further comprising a sealing ring interposed between said locking ring-nut and said connector body, so as to prevent the passage of water at the central portion of the connector.

13. Electric connector according to claim 4, further comprising a positioning element which can be mounted within said connector body and having a front portion adapted to receive and lock thereon said contact elements, before these contact elements are inserted into the connector body.

14. Electric connector according to claim 13, wherein said positioning element comprises a rear portion provided with retaining longitudinal tabs which are elastically deformable and have at their free ends wedge-like teeth cooperating with respective windows formed on the rear end of said connector body, for snap-locking said positioning element within said connector body.

15. Electric connector according to claim 4, wherein an inner surface of a front portion of said locking ring-nut has a thread adapted to cooperate with said threaded portion of the rear end of the connector body.

* * * * *